US009695562B2

(12) United States Patent
Lukaj

(10) Patent No.: US 9,695,562 B2
(45) Date of Patent: Jul. 4, 2017

(54) SNOW VAPORIZATION ASSEMBLY

(71) Applicant: Aleksander Lukaj, Middlevillage, NY (US)

(72) Inventor: Aleksander Lukaj, Middlevillage, NY (US)

( * ) Notice: Subject to any disclaimer, the term of this patent is extended or adjusted under 35 U.S.C. 154(b) by 158 days.

(21) Appl. No.: 14/640,209

(22) Filed: Mar. 6, 2015

(65) Prior Publication Data

US 2016/0258123 A1 Sep. 8, 2016

(51) Int. Cl.
*E01H 5/10* (2006.01)

(52) U.S. Cl.
CPC ..... *E01H 5/104* (2013.01)

(58) Field of Classification Search
CPC ..... E01H 5/104
See application file for complete search history.

(56) References Cited

U.S. PATENT DOCUMENTS 1,746,417 A 2/1930 Chrul
3,106,792 A * 10/1963 Park ..... 126/343.5 R
3,333,354 A 8/1967 Kirshenblat
3,766,586 A * 10/1973 Krickovich ..... E01H 5/104 15/340.3
3,803,732 A * 4/1974 Moreno ..... E01H 5/104 126/343.5 A
4,071,966 A * 2/1978 Cohen ..... E01H 5/104 193/31 A
4,164,820 A * 8/1979 Krickovich ..... E01H 1/0845 15/340.3
4,226,034 A 10/1980 Benjamin et al.
D281,109 S 10/1985 van Ranij
4,785,561 A * 11/1988 Swanson ..... E01H 5/104 126/343.5 R
5,079,865 A * 1/1992 Hutson ..... E01H 5/104 126/271.1
5,266,220 A * 11/1993 Hammond ..... E01H 5/102 126/343.5 R
5,365,681 A 11/1994 Miranda
5,953,837 A 9/1999 Clifford
7,958,656 B2 6/2011 Soderberg et al.
2011/0253803 A1* 10/2011 Kennedy ..... A01M 21/04 239/71
2014/0305010 A1* 10/2014 Fonseca ..... E01H 5/104 37/228
2016/0053452 A1* 2/2016 Treglown ..... E01H 5/104 37/228

* cited by examiner

*Primary Examiner* — Thomas B Will
*Assistant Examiner* — Jessica H Lutz

(57) ABSTRACT

A snow vaporization assembly includes a vehicle that has a cab and a box. The cab has a front side and the box has a top side. A collection unit is attached to the vehicle and the collection unit collects snow while the vehicle is driven. A vaporizing unit is positioned within the box and the vaporizing unit is in fluid communication with the collection unit. The vaporizing unit converts the snow collected by the collection unit into steam. The vaporizing unit expels the steam from the vehicle.

4 Claims, 3 Drawing Sheets

SNOW VAPORIZATION ASSEMBLY

BACKGROUND OF THE DISCLOSURE

Field of the Disclosure

The disclosure relates to vaporization devices and more particularly pertains to a new vaporization device for vaporizing snow while the snow is being collected.

Summary of the Disclosure

An embodiment of the disclosure meets the needs presented above by generally comprising a vehicle that has a cab and a box. The cab has a front side and the box has a top side. A collection unit is attached to the vehicle and the collection unit collects snow while the vehicle is driven. A vaporizing unit is positioned within the box and the vaporizing unit is in fluid communication with the collection unit. The vaporizing unit converts the snow collected by the collection unit into steam. The vaporizing unit expels the steam from the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
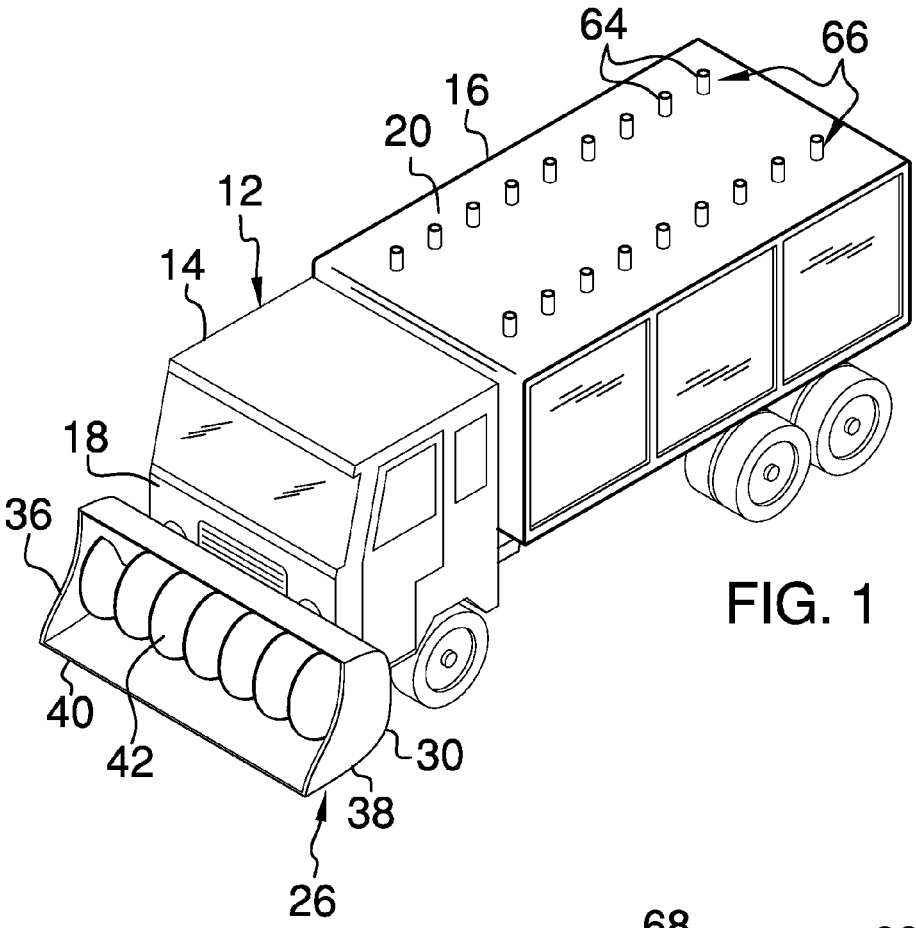
FIG. 1 is a top perspective view of a snow vaporization assembly according to an embodiment of the disclosure.
Figure 2:
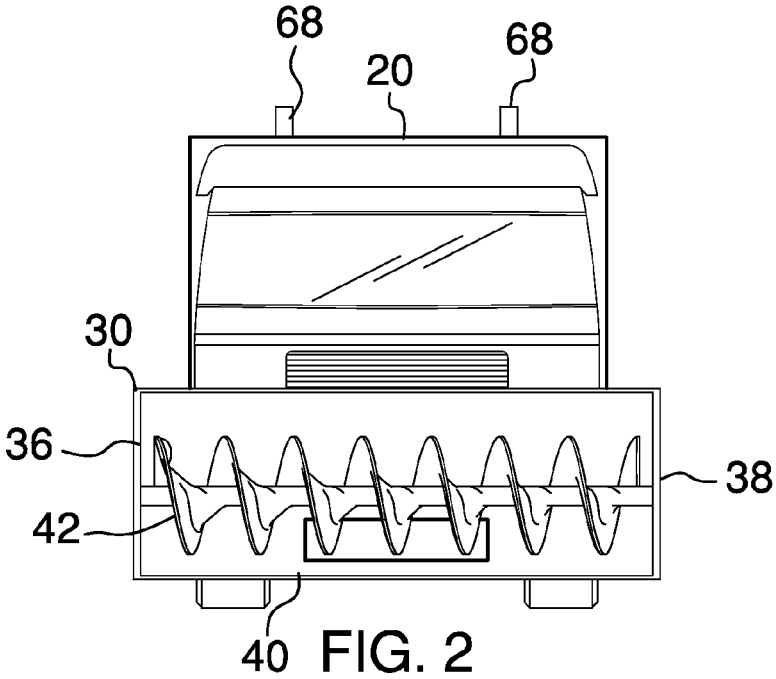
FIG. 2 is a front view of an embodiment of the disclosure.
Figure 3:
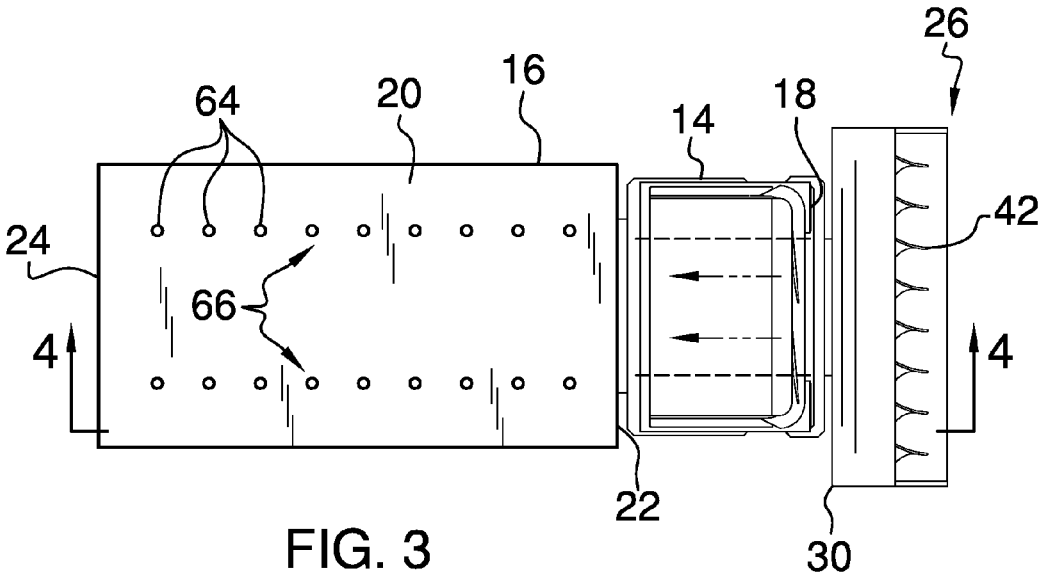
FIG. 3 is a top view of an embodiment of the disclosure.
Figure 4:
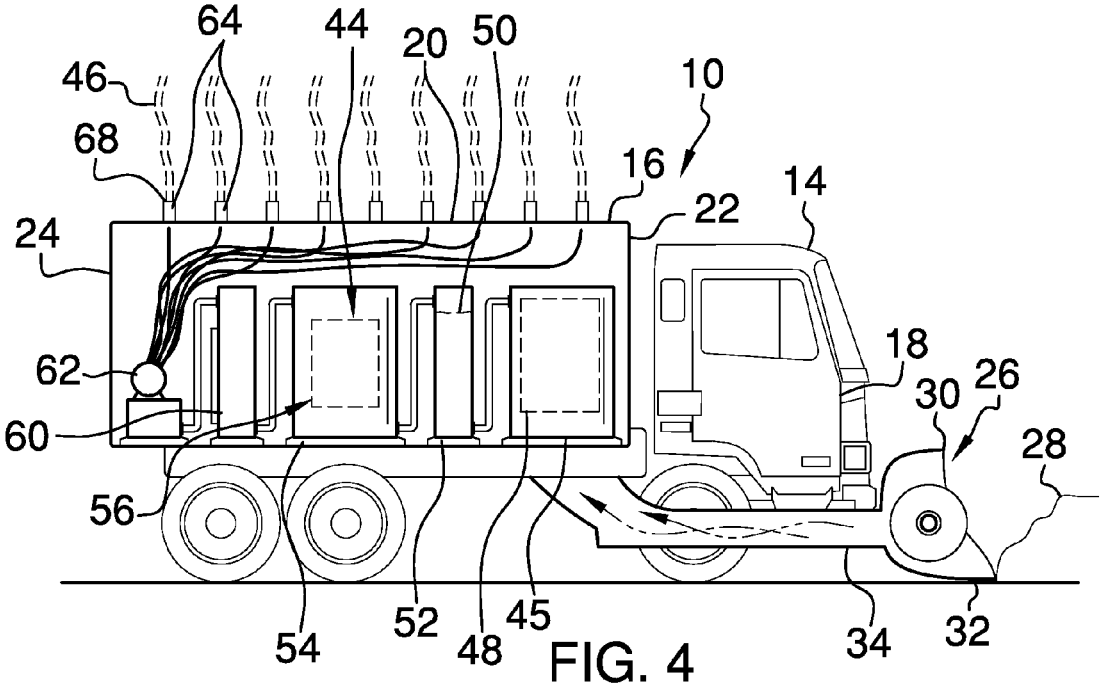
FIG. 4 is a right side cut away view of an embodiment of the disclosure.
Figure 5:
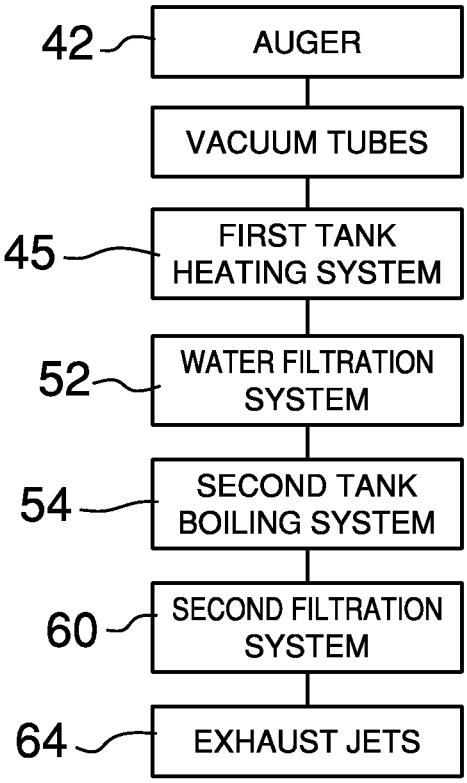
FIG. 5 is a schematic view of an embodiment of the disclosure.

With reference now to the drawings, and in particular to FIGS. 1 through 5 thereof, a new vaporization device embodying the principles and concepts of an embodiment of the disclosure and generally designated by the reference numeral 10 will be described.

As best illustrated in FIGS. 1 through 5, the snow vaporization assembly 10 generally comprises a vehicle 12 that has a cab 14 and a box 16. The vehicle 12 may be a truck or the like. The cab 14 has a front side 18 and the box 16 has a top side 20, a front end 22 and a back end 24. The box 16 is positioned behind the cab 14.

A collection unit 26 is attached to the vehicle 12 to collect snow 28 while the vehicle 12 is driven. The collection unit 26 comprises a chute 30 that has a collection portion 32 and a duct portion 34. The collection portion 26 has a first lateral side 36, a second lateral side 38, a front end 40 and the front end 40 is open. The collection portion 26 is attached to the front side 18 of the cab 14 and the front end 40 of the collection portion 26 is directed forwardly from the cab 14 to collect the snow 28 while the vehicle 12 is driven. The duct portion 34 extends between the collection portion 26 and the box 16, placing the collection portion 26 is in fluid communication with the box 16.

An auger 42 is provided that is rotatably attached to the chute 30 and the auger 42 is positioned within the collection portion 26. The auger 42 extends between the first lateral side 36 and the second lateral side 38 and the auger 42 urges the snow through the duct portion 34 and into the box 16. The auger 42 is in mechanical communication with the vehicle 12 whereby the vehicle 12 selectively rotates the auger 42.

A vaporizing unit 44 is positioned within the box 16 and the vaporizing unit 44 is in fluid communication with the collection unit 26. The vaporizing unit 44 converts the snow 28 collected by the collection unit 26 into steam 46 and the vaporizing unit 44 expels the steam 46 from the vehicle 12. The vaporizing unit 44 comprises a first tank 45 positioned within the box 16. The first tank 45 is fluidly coupled to the duct portion 34 of the chute 30 such that the first tank 45 receives the snow 28 urged by the auger 42.

A first heating element 48 is coupled to the first tank 45 and the first heating element 48 is electrically coupled to the vehicle 12. The first heating element 48 heats the first tank 45 to a temperature that is above a melting point of the snow 28 thereby facilitating the first heating element 48 to melt the snow 28 contained in the first tank 45 into water 50. The first heating element 48 may comprise an electrical heating element or the like. A first filter 52 is positioned within the box 16 and the first filter 52 is fluidly coupled to the first tank 45. The first filter 52 receives the water 50 from the first tank 45 such that the first filter 52 filters the water 50. The first filter 52 may be a particulate filter or the like.

A second tank 54 is positioned within the box 16 and the second tank 54 is fluidly coupled to the first filter 52 to receive the water 50 filtered by the first filter 52. A second heating element 56 is coupled to the second tank 54 and the second heating element 56 is electrically coupled to the vehicle 12. The second heating element 56 heats the second tank 54 to a temperature above a boiling point of the water 50 to convert the water 50 contained in the second tank 54 into steam 46. The second heating element 56 may comprise an electrical heating element or the like.

A second filter 60 is positioned within the box 16 and the second filter 60 is fluidly coupled to the second tank 54. The second filter 60 receives the steam 46 from the second tank 54 whereby the second filter 60 removes odor from the steam 46. The second filter 60 may be a charcoal filter or the like. A pump 62 is positioned within the box 16 and the pump 62 is electrically coupled to the vehicle 12. The pump 62 is fluidly coupled to the second filter 60 whereby the pump 62 communicates a suction pressure to the first tank 45. The pump 62 urges the water 50 from the first tank 45 into the second tank 54 and the pump 62 urges the steam 46 from second tank 54 into the pump 62. Additionally, the pump 62 urges the snow 28 from the duct portion 34 into the first tank 45. The pump 62 may be an electrically actuated fluid pump or the like.

A plurality of nozzles 64 is provided and each of the nozzles 64 is coupled to the top side 20 of the box 16. The nozzles 64 are spaced apart from each other and are distributed between the front end 22 of the box 16 and the back end 24 of the box 16.

Additionally, the nozzles 64 may be arranged in a pair of rows 66 that are spaced apart from each other. Each of the nozzles 64 has a distal end 68 with respect to the top side 20 of the box 16 and the distal end 68 of each of the nozzles 64 is open. Each of the nozzles 64 is fluidly coupled to the pump 62 whereby the pump 62 urges the steam 46 outwardly through the distal end 68 of the nozzles 64.

In use, the vehicle 12 is driven in order to collect the snow 28. The snow 28 is melted in the first tank 45 and the water 50 is boiled into the steam 46 in the second tank 54. The steam 46 is expelled through the nozzles 64 while the vehicle 12 collects the snow 28. The vaporizing unit 44 allows the snow 28 to be collected without having to deposit the snow 28 in a collection area after the snow 28 has been collected.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A snow vaporization assembly configured to remove snow from a surface and vaporize the snow, said assembly comprising:

a vehicle has a cab and a box, said cab has a front side, said box has a top side;

a collection unit attached to said vehicle, said collection unit being configured to collect snow while said vehicle is driven, said collection unit comprising a chute having a collection portion and a duct portion, said collection portion having a first lateral side, a second lateral side and a front end, said front end being open, said collection portion being attached to said front side of said cab, said front end of said collection portion being directed forwardly from said cab such that said front end is configured to collect the snow while said vehicle is driven, said duct portion extending under said cab between said collection portion and said box such that said collection portion is in fluid communication with said box;

a vaporizing unit positioned within said box, said vaporizing unit being in fluid communication with said collection unit, said vaporizing unit being configured to convert the snow collected by said collection unit into steam, said vaporizing unit being configured to expel the steam from said vehicle;

an auger coupled to said chute;

said vaporizing unit comprising a first tank positioned within said box, said first tank being fluidly coupled to said duct portion of said chute such that said first tank is configured to receive the snow urged by said auger;

a first heating element coupled to said first tank, said first heating element being electrically coupled to said vehicle, said first heating element heating said first tank to a temperature above a melting point of snow such that said first heating element is configured to melt the snow contained in said first tank into water;

a first filter positioned within said box, said first filter being fluidly coupled to said first tank, said first filter being configured to receive the water from said first tank such that said first filter filters the water;

a second tank positioned within said box, said second tank being fluidly coupled to said first filter such that second tank is configured to receive the water filtered by said first filter;

a second heating element coupled to said second tank, said second heating element being electrically coupled to said vehicle, said second heating element heating said second tank to a temperature above a boiling point of water such that said second heating element is configured to convert the water contained in said second tank into steam;

a second filter positioned within said box, said second filter being fluidly coupled to said second tank, said second filter being configured to receive the steam from said second tank whereby said second filter removes odor from the steam; and a pump positioned within said box, said pump being electrically coupled to said vehicle, said pump being fluidly coupled to said second filter whereby said pump communicates a suction pressure to said first tank, said pump being configured to urge the water from said first tank into said second tank and urge the steam from second tank into said pump.

2. The assembly according to claim 1, further comprising an auger rotatably attached to said chute, said auger being positioned within said collection portion, said auger extending between said first lateral side and said second lateral side, said auger being configured to urge the snow through said duct portion and into said box, said auger being in mechanical communication with said vehicle whereby said vehicle selectively rotates said auger.

3. The assembly according to claim 1, further comprising a plurality of nozzles, each of said nozzles being coupled to said top side of said box, each of said nozzles has a distal end with respect to said top side, said distal end of each of said nozzles being open, each of said nozzles being fluidly coupled to said pump whereby said pump is configured to urge the steam outwardly through said distal end of said nozzles.

4. A snow vaporization assembly configured to remove snow from a surface and vaporize the snow, said assembly comprising:

a vehicle has a cab and a box, said cab has a front side, said box has a top side;

a collection unit attached to said vehicle, said collection unit being configured to collect snow while said vehicle is driven, said collection unit comprising:

a chute has a collection portion and a duct portion, said collection portion has a first lateral side, a second lateral side and a front end, said front end being open, said collection portion being attached to said front side of said cab, said front end of said collection portion being directed forwardly from said cab such that said front end is configured to collect the snow while said vehicle is driven, said duct portion extending under said cab between said collection portion and said box such that said collection portion is in fluid communication with said box; and an auger rotatably attached to said chute, said auger being positioned within said collection portion, said auger extending between said first lateral side and said second lateral side, said auger being configured to urge the snow through said duct portion and into said box, said auger being in mechanical communication with said vehicle whereby said vehicle selectively rotates said auger; and a vaporizing unit positioned within said box, said vaporizing unit being in fluid communication with said collection unit, said vaporizing unit being configured to convert the snow collected by said collection unit into steam, said vaporizing unit being configured to expel the steam from said vehicle, said vaporizing unit comprising:

a first tank positioned within said box, said first tank being fluidly coupled to said duct portion of said chute such that said first tank is configured to receive the snow urged by said auger;

a first heating element coupled to said first tank, said first heating element being electrically coupled to said vehicle, said first heating element heating said first tank to a temperature above a melting point of snow such that said first heating element is configured to melt the snow contained in said first tank into water;

a first filter positioned within said box, said first filter being fluidly coupled to said first tank, said first filter being configured to receive the water from said first tank such that said first filter filters the water;

a second tank positioned within said box, said second tank being fluidly coupled to said first filter such that second tank is configured to receive the water filtered by said first filter;

a second heating element coupled to said second tank, said second heating element being electrically coupled to said vehicle, said second heating element heating said second tank to a temperature above a boiling point of water such that said second heating element is configured to convert the water contained in said second tank into steam;

a second filter positioned within said box, said second filter being fluidly coupled to said second tank, said second filter being configured to receive the steam from said second tank whereby said second filter removes odor from the steam;

a pump positioned within said box, said pump being electrically coupled to said vehicle, said pump being fluidly coupled to said second filter whereby said pump communicates a suction pressure to said first tank, said pump being configured to urge the water from said first tank into said second tank and urge the steam from second tank into said pump; and a plurality of nozzles, each of said nozzles being coupled to said top side of said box, each of said nozzles has a distal end with respect to said top side, said distal end of each of said nozzles being open, each of said nozzles being fluidly coupled to said pump whereby said pump is configured to urge the steam outwardly through said distal end of said nozzles.

* * * * *